US010258220B2

(12) United States Patent
Buesing et al.

(10) Patent No.: US 10,258,220 B2
(45) Date of Patent: Apr. 16, 2019

(54) DISH WASHING MACHINE INCLUDING DISTRIBUTOR

(71) Applicant: SAMSUNG ELECTRONICS CO., LTD., Suwon-si, Gyeonggi-do (KR)

(72) Inventors: Johannes Buesing, Yongin-si (KR); Soo Hyung Yoo, Suwon-si (KR); Ji Sun Yang, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 15/298,448

(22) Filed: Oct. 20, 2016

(65) Prior Publication Data

US 2017/0112350 A1 Apr. 27, 2017

(30) Foreign Application Priority Data

Oct. 21, 2015 (KR) ..... 10-2015-0146848

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4225* (2013.01)

(58) Field of Classification Search
CPC ..... A47L 15/4282
See application file for complete search history.

(56) References Cited

U.S. PATENT DOCUMENTS

2004/0103926 A1 6/2004 Ha
2009/0139553 A1 6/2009 Park
2010/0043840 A1* 2/2010 Kim ..... A47L 15/0052 134/34
2011/0129337 A1* 6/2011 Wan ..... D06F 39/085 415/206
2013/0319481 A1 12/2013 Welch
2015/0150430 A1 6/2015 Wee et al.

FOREIGN PATENT DOCUMENTS

| | | |
|---|---|---|
| CH | 571852 | 1/1976 |
| EP | 1404208 A1 | 4/2004 |
| EP | 1 101 435 A2 | 5/2011 |
| KR | 10-2015-0079382 | 7/2015 |

OTHER PUBLICATIONS

International Search Report dated Feb. 3, 2017, from International Application No. PCT/KR2016/011883, 3 pages.
Extended European Search Report dated Mar. 23, 2018 in European Patent Application No. 16857810.2.

* cited by examiner

*Primary Examiner* — Jason Y Ko
(74) *Attorney, Agent, or Firm* — Staas & Halsey LLP

(57) ABSTRACT

A dish washing machine includes a plurality of jet nozzles which jet washing water, a sump which stores washing water, a pump which includes a pumping motor pumping the washing water stored in the sump and a housing comprising a plurality of outlets, and a distributor which distributes the washing water pumped by the pump to the plurality of jet nozzles through the plurality of outlets. The distributor includes at least one opening and closing member configured to be rotatable in the housing of the pump to selectively open and close the plurality of outlets, and a distributor motor which rotates the at least one opening and closing member about a motor shaft which faces a direction different from a direction which a motor shaft of the pumping motor faces.

20 Claims, 19 Drawing Sheets

DISH WASHING MACHINE INCLUDING DISTRIBUTOR

CROSS-REFERENCE TO RELATED APPLICATIONS

This application claims the priority benefit of Korean Patent Application No. 10-2015-0146848, filed on Oct. 21, 2015 in the Korean Intellectual Property Office, the disclosure of which is incorporated herein by reference in its entirety.

BACKGROUND

1. Field

Embodiments of the disclosure relate to a dish washing machine including a distributor for selectively supplying washing water to jet nozzles.

2. Description of the Related Art

A dish washing machine is a home appliance which includes a body provided with a washing tub, a basket for accommodating dishes, a sump for storing washing water, jet nozzles for spraying the washing water, and a pump for supplying the washing water in the sump to the jet nozzles and washes dishes by spraying washing water to dishes at a high pressure.

Generally, dish washing machines each employ a rotor-type jet structure having a rotating jet nozzle. A rotating nozzle jets washing water while rotating due to a water pressure. Since such a rotating nozzle jets the washing water only within a range limited by a radius of rotation, an area to which the washing water is not jetted may occur. Accordingly, to prevent the area to which the washing water is not jetted from occurring, so-called linear type jet structures have been provided. Linear type jet structures each include a fixed nozzle fixed to one side of a washing tub and a vane which moves inside the washing tub and deflects washing water jetted from the fixed nozzle toward dishes, thereby jetting the washing water to all areas of the washing tub according to the movement of a deflection plate.

In this case, to separately wash a partial area of the washing tub, it is necessary to selectively supply washing water to each of the jet nozzles. For this, a dish washing machine may include a distributor. The distributor may be, for example, positioned outside a housing of the pump.

When the distributor is positioned outside the housing of the pump, the distributor may include an inlet into which washing water pumped by the pump flows and a plurality of outlets through which washing water which flows in is discharged. In this case, the housing of the distributor may include a plurality of opening and closing members capable of opening and closing the plurality of outlets, and the plurality of opening and closing members may selectively open and close the plurality of outlets using torque of a motor of the distributor. Accordingly, the washing water may be selectively supplied to each of the plurality of jet nozzles.

SUMMARY

Therefore, it is an aspect of the disclosure to provide a dish washing machine including a distributor of washing water which minimizes pressure loss of the washing water and increases space utilization.

It is another aspect of the disclosure to improve a water circulation system of a dish washing machine. That is, for less consumption of energy and water, an amount of water supplied to the water circulation system and pressure loss occurring at the water circulation system may be reduced.

Additional aspects of the disclosure will be set forth in part in the description which follows and, in part, will be apparent from the description or may be learned by practice of the disclosure.

In accordance with an aspect of the disclosure, a dish washing machine may include a body, a plurality of jet nozzles which jet washing water, a sump which stores washing water, a pump which comprises a pumping motor pumping the washing water stored in the sump and a housing comprising a plurality of outlets, and a distributor which distributes the washing water pumped by the pump to the plurality of jet nozzles through the plurality of outlets. The distributor may include at least one opening and closing member configured to be rotatable in the housing of the pump to selectively open and close the plurality of outlets, and a distributor motor which rotates the at least one opening and closing member about a motor shaft which faces a direction different from a direction which a motor shaft of the pumping motor faces.

At least one of the plurality of outlets may be open in a longitudinal direction of the housing.

At least one of the plurality of outlets may be open in an upward direction of the housing.

At least one of the plurality of outlets may be open in a downward direction by an angle from 40 degrees to 50 degrees in a longitudinal direction of the housing.

A direction of the motor shaft which faces the direction different from an axial direction of the pumping motor may be identical to a longitudinal direction of the housing of the pump.

A direction of the motor shaft which faces the direction different from an axial direction of the pumping motor may be perpendicular or approximately perpendicular to the axial direction of the pumping motor.

The distributor may be detachably coupled with one longitudinal end portion of the housing.

When there are a plurality of such at least one opening and closing member, a first opening and closing member of the opening and closing members may be provided at one end of the motor shaft and a second opening and closing member may be provided between both ends of the motor shaft.

The opening and closing member may comprise at least one ridge and at least one valley, and wherein according to rotation of the motor shaft, one of the plurality of outlets may be closed by the at least one ridge and another of the plurality of outlets may be opened by the at least one valley.

The opening and closing member may comprise a cap which comes into close contact with a hole of the at least one outlet and cuts off leakage of the washing water when at least one of the plurality of outlets is closed by the opening and closing member.

The opening and closing member may comprise at least one ridge and at least one valley, and the at least one ridge may comprise a guide surface which guides washing water.

The opening and closing member may comprise a first blade and a second blade and closes at least one of the plurality of outlets using the first blade or the second blade.

The opening and closing member may comprise a lever which is positioned between the first blade and the second blade and supports the first blade or the second blade to come into close contact with a hole of at least one of the plurality of outlets when the at least one of the plurality of outlets is closed by the opening and closing member.

The housing may comprise a spiral partition wall formed along an inner circumferential surface of the housing to provide a flow channel of washing water.

The distributor further may comprise a cam member coupled with the motor shaft to rotate with the opening and closing member and a micro switch in contact with the cam member to sense a rotation position of the opening and closing member.

The cam member may comprise a convex portion and a concave portion alternately formed along a circumferential direction to turn on and off the micro switch according to rotation.

The distributor may further comprise a control portion which designates rotation positions of the opening and closing member according to time of turning on and off of the micro switch and rotates or stops the motor to rotate the opening and closing member to a necessary rotation position among the rotation positions.

According to rotation of the motor shaft, a first outlet, among the plurality of outlets, provided in a longitudinal direction of the housing and a second outlet which faces downward from the longitudinal direction by an angle from 40 degrees to 50 degrees.

At least one of a first outlet and a second outlet, among the plurality of outlets, open in an upward direction may be selectively opened and closed.

In accordance with an aspect of the disclosure, a dish washing machine may include a pump which comprises a pumping motor pumping washing water and a housing comprising a plurality of outlets, and a distributor which distributes the pumped washing water to a plurality of jet nozzles through the plurality of outlets. The distributor may include at least one opening and closing member configured to be rotatable in the housing of the pump to selectively open and close the plurality of outlets, and a distributor motor which rotates the at least one opening and closing member about a motor shaft which faces a direction different from a direction which a shaft of the pumping motor faces.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
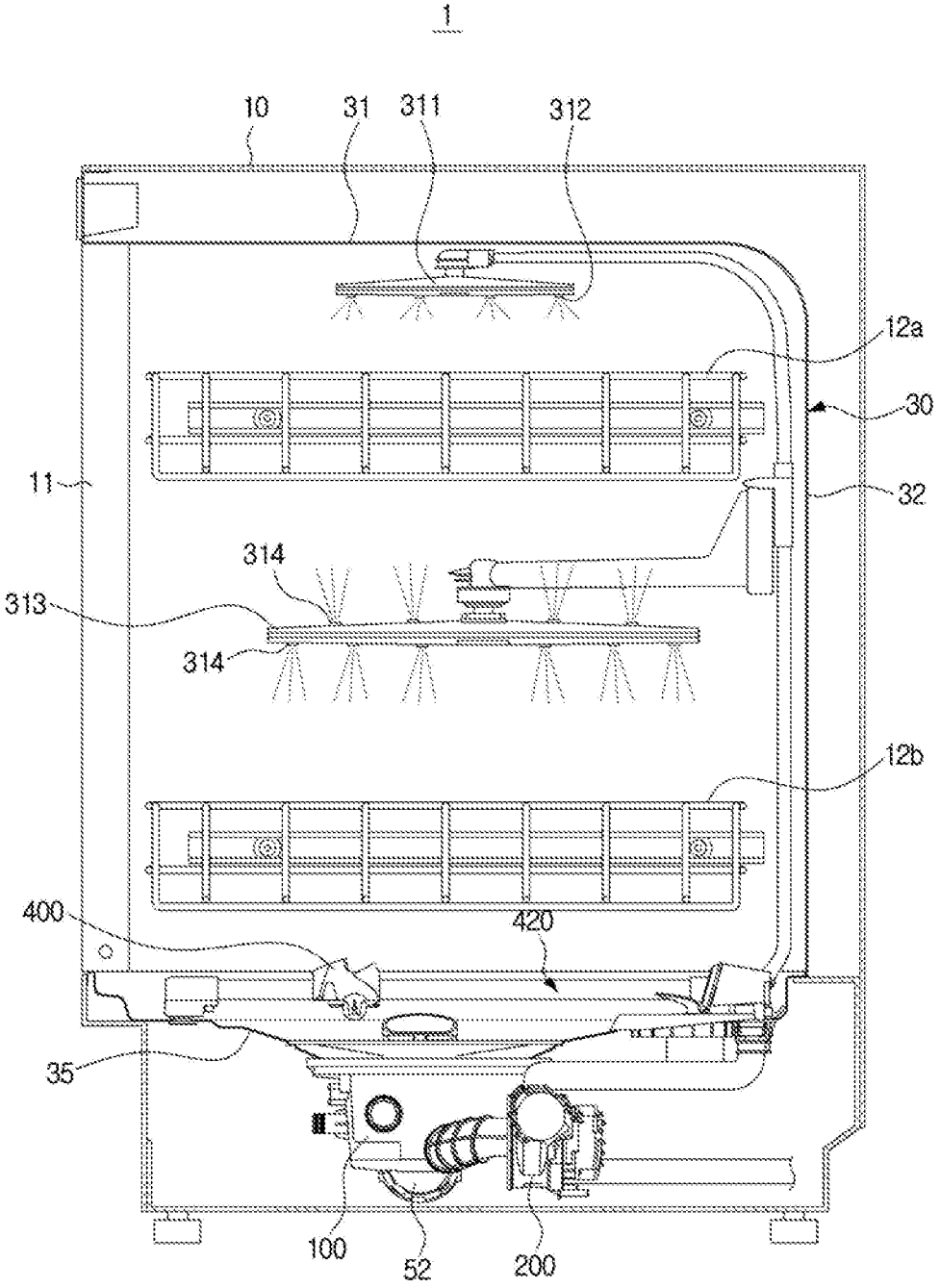
FIG. 1 is a schematic cross-sectional view of a dish washing machine according to an embodiment of the disclosure.

Reference will now be made in detail to the embodiments, examples of which are illustrated in the accompanying drawings, wherein like reference numerals refer to like elements throughout. The embodiments are described below to explain the disclosure by referring to the figures.

Hereinafter, exemplary embodiments of the disclosure will be described in detail.

Figure 2:
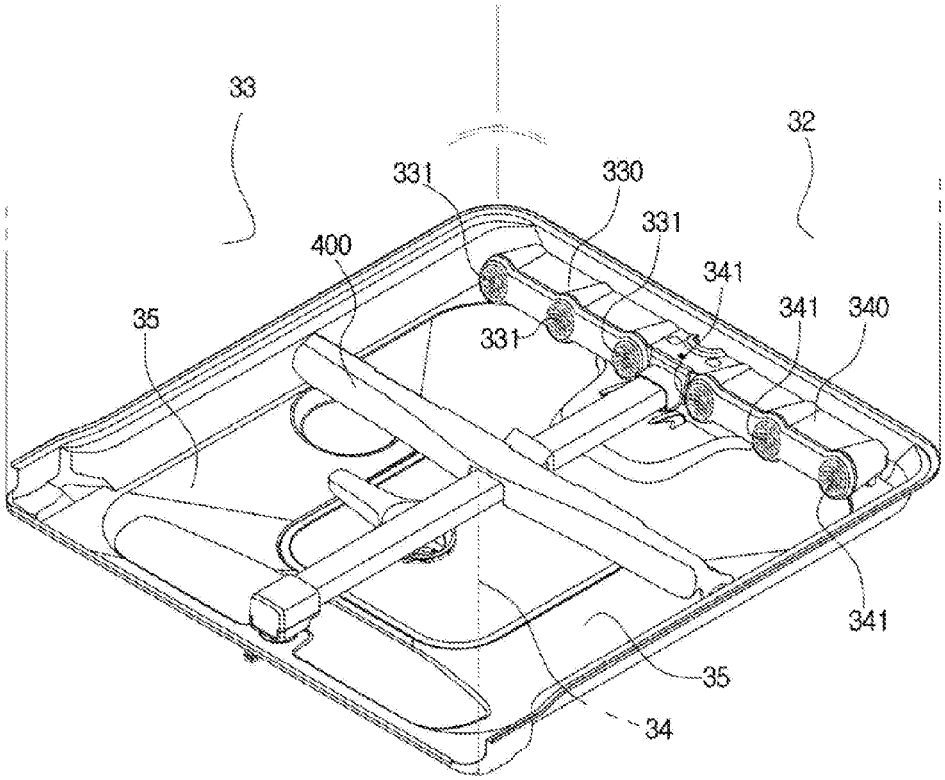
FIG. 2 is a bottom view of the dish washing machine of FIG. 1.

FIG. 1 is a schematic cross-sectional view of a dish washing machine according to an embodiment of the disclosure. FIG. 2 is a bottom view of the dish washing machine of FIG. 1.

Referring to FIGS. 1 and 2, the entire structure of the dish washing machine according to an embodiment of the disclosure will be generally described A dish washing machine 1 includes a body 10 which forms an exterior, a washing tub 30 provided in the body 10, baskets 12*a* and 12*b* provided in the washing tub 30 to store dishes, jet nozzles 311, 313, 330, and 340 which jet washing water, a sump 100 which stores washing water, a pump 200 which pumps and supplies the washing water of the sump 100 to the jet nozzles 311, 313, 330, and 340, a drain pump 52 which discharges the washing water of the sump 100 outward from the body 10, along with garbage, a vane 400 which deflects washing water toward dishes while moving in the washing tub 30, and a driving device 420 which drives the vane 400.

The washing tub 30 may have an approximate box shape with an open front to put in or take out dishes. A front opening of the washing tub 30 may be opened and closed by a door 11. The washing tub 30 may include a top wall 31, a rear wall 32, a left wall 33, a right wall 34, and a bottom plate 35.

The baskets 12*a* and 12*b* may be wire racks formed of wires for washing water not to stay and pass therethrough. The baskets 12*a* and 12*b* may be detachably provided in the washing tub 30. The baskets 12*a* and 12*b* may include an upper basket 12*a* disposed at top of the washing tub 30 and a lower basket 12*b* disposed at bottom of the washing tub 30.

The jet nozzles 311, 313, 330, and 340 may wash dishes by jetting washing water at a high pressure. The jet nozzles 311, 313, 330, and 340 may include an upper rotating nozzle 311 provided on top of the washing tub 30, an intermediate rotating nozzle 313 provided at the center of the washing tub 30, and fixed nozzles 330 and 340 provided at bottom of the washing tub 30.

The upper rotating nozzle 311 may be provided above the upper basket 12*a* and may jet washing water downward while rotating due to water pressure. For this, jet holes 312 may be provided at a bottom end of the upper rotating nozzle 311. The upper rotating nozzle 311 may directly jet washing water toward dishes stored in the upper basket 12*a*.

The intermediate rotating nozzle 313 may be provided between the upper basket 12*a* and the lower basket 12*b* and may jet washing water upward and downward while rotating due to water pressure. For this, the jet holes 314 may be provided at a top end and a bottom end of the intermediate rotating nozzle 313. The intermediate rotating nozzle 313 may directly jet washing water toward dishes stored in the upper basket 12*a* and the lower basket 12*b*.

The fixed nozzles 330 and 340 are provided not to move and be fixed to one side of the washing tub 30 unlike the rotating nozzles 311 and 313. The fixed nozzles 330 and 340 may be disposed approximately adjacent to the rear wall 32 of the washing tub 30 and may jet washing water toward a front of the washing tub 30. Accordingly, the washing water jetted from the fixed nozzles 330 and 340 may not directly face dishes.

The washing water jetted from the fixed nozzles 330 and 340 may be deflected by the vane 400 toward dishes. The fixed nozzles 330 and 340 may be disposed below the lower basket 12*b*, and the vane 400 may deflect the washing water jetted from the fixed nozzles 330 and 340 upward. That is, the washing water jetted from the fixed nozzles 330 and 340 may be deflected by the vane 400, toward dishes stored in the basket 12*b*.

The fixed nozzles 330 and 340 may include a plurality of jet holes 331 and 341 arranged on the left and right of the washing tub 30, respectively. The plurality of jet holes 331 and 341 may jet washing water forward.

The vane 400 may extend left and right of the washing tub 30 to deflect all of the washing water jetted from the plurality of jet holes 331 and 341 of the fixed nozzles 330 and 340. That is, one longitudinal end of the vane 400 may be provided to be adjacent to the left wall 33 of the washing tub 30, and another longitudinal end of the vane 400 may be provided to be adjacent to the right wall 34.

The vane 400 may linearly reciprocate along a jet direction of the washing water jetted from the fixed nozzles 330 and 340. That is, the vane 400 may linearly reciprocate along a front-and-rear direction of the washing tub 30.

Accordingly, a linear jet structure including the fixed nozzles 330 and 340 and the vane described above may wash the whole area of the washing tub 30 without a blind spot. It is differentiated from rotating nozzles capable of jetting washing water only in a range limited by the rotation radius thereof.

The fixed nozzles 330 and 340 may include a left fixed nozzle 330 disposed on the left of the washing tub 30 and a right fixed nozzle 340 disposed on the right of the washing tub 30.

The rotating nozzles 311 and 313 and the fixed nozzles 330 and 340 may independently jet washing water from each other, which will be described. In addition, the left fixed nozzle 330 and the right fixed nozzle 340 may also independently jet washing water.

The washing water jetted from the left fixed nozzle 330 may be deflected by the vane 400 only to an area on the left of the washing tub 30, and the washing water jetted from the right fixed nozzle 340 may be deflected by the vane 400 only to an area on the right of the washing tub 30.

Accordingly, the dish washing machine 1 may independently and separately wash left side and right side of the washing tub 30. Unlike the embodiment, it may not only be divided into left and right but also be further subdivided as necessary.

Also, in the dish washing machine according to an embodiment, a rotary type jet structure is applied to upper and intermediate nozzles and a linear type jet structure is applied to a lower nozzle. It is irrelevant to the concept of the disclosure whether a jet structure is a rotary type or a linear type, and the concept of the disclosure may be applied regardless of the jet structure.

Main components of the dish washing machine 1 according to an embodiment of the disclosure described above will be sequentially described below.

Figure 3:
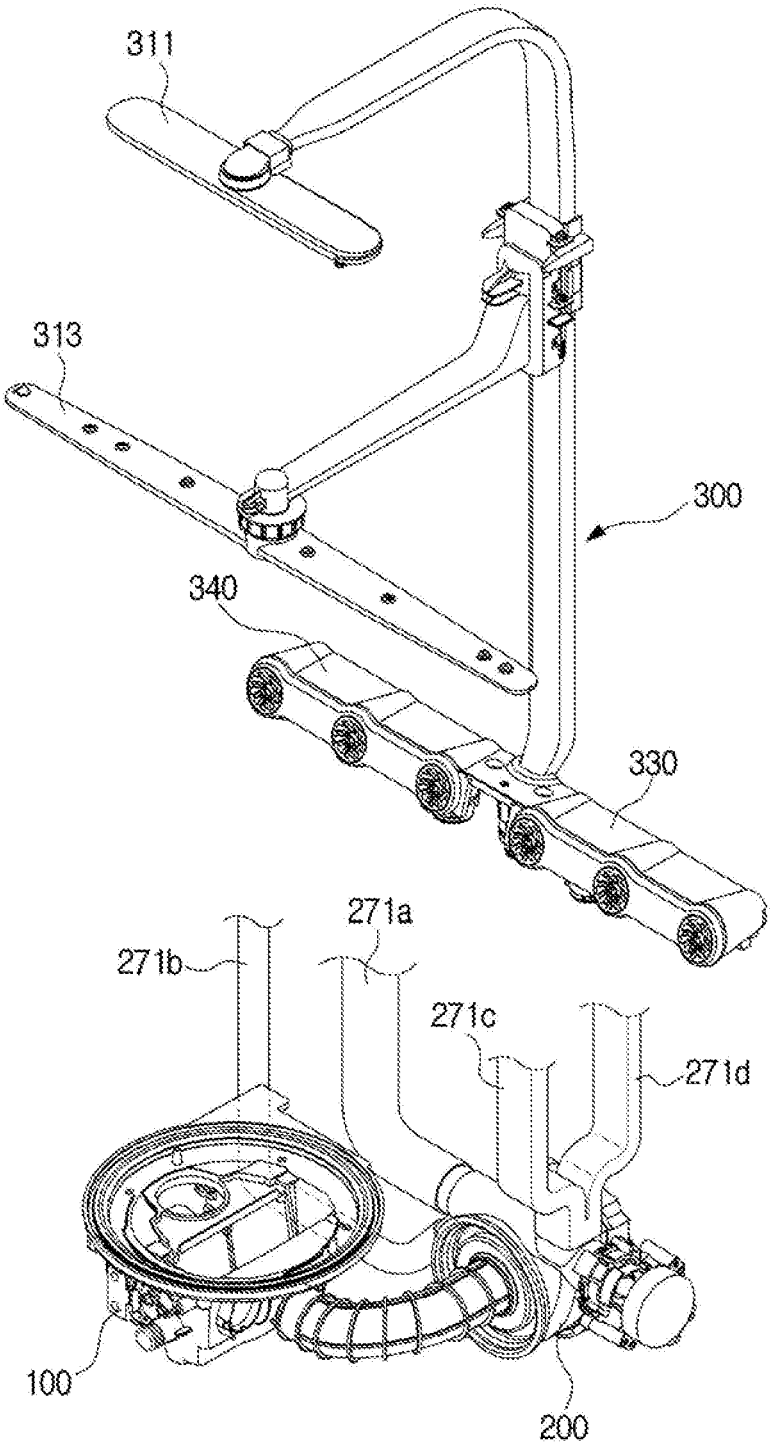
FIG. 3 is a view illustrating a flow channel structure of the dish washing machine 1.

FIG. 3 is a view illustrating a flow channel structure of the dish washing machine 1.

Referring to FIG. 3, an operation, a flow channel structure, a fixed nozzle assembly structure 300, and a washing water distribution structure of the dish washing machine according to an embodiment of the disclosure will be described.

The dish washing machine may include a water supply operation, a washing operation, a draining operation, and a drying operation.

In the water supply operation, washing water may be supplied to the washing tub 30 through a water supply pipe (not shown). The washing water supplied to the washing tub 30 may flow to the sump 100 provided at a bottom of the washing tub 30 due to a gradient of the bottom plate 35 of the washing tub 30 and may be stored in the sump 100.

In the washing operation, the pump 200 is operated to pump the washing water of the sump 100. The washing water pumped by the pump 200 may be distributed to the rotating nozzles 311 and 313, the left fixed nozzle 330, and the right fixed nozzle 340 through a distributor 250. The washing water may be jetted to wash dishes from the jet nozzles 311, 313, 330, and 340 at a high pressure due to pumping force of the pump 200.

Here, the upper rotating nozzle 311 may receive washing water from the pump 200 through a first hose 271*a*. The intermediate rotating nozzle 313 may receive washing water from the distributor 250 through a second hose 271*b*. The left fixed nozzle 330 may receive washing water from the distributor 250 through a third hose 271*c*. The right fixed nozzle 340 may receive washing water from the pump 200 through a fourth hose 271*d*.

In the embodiment, it has been generally described that the pump 200 includes three distribution modes. However, the pump 200 is not limited to the number of modes described above and may be configured to include various number of distribution modes depending on a motor shaft rotation angle, the number of rotations, etc.

For example, in a first mode, the pump 200 may supply washing water only to the intermediate rotating nozzle 313 and the right fixed nozzle 340 through the second hose 271*b* and the fourth hose 271*d*.

In a second mode, the pump 200 may supply washing water only to the intermediate rotating nozzle 313 and the left fixed nozzle 330 through the second hose 271*b* and the third hose 271*c*.

In a third mode, the pump 200 may supply washing water only to the upper rotating nozzle 311 through the first hose 271*a*.

The washing water jetted from the jet nozzles 311, 313, 330, and 340 may hit dishes to remove garbage on the dishes, may fall with the garbage, and may be stored at the sump 100 again. The pump 200 pumps again and circulates the washing water stored in the sump 100. In the washing operation, the pump 200 may repeat operating and suspending several times. In this process, the garbage falling with the washing water to the sump 100 is collected by a filter mounted on the sump 100, does not circulate through the jet nozzles 311, 313, 330, and 340, and stays at the sump 100.

In the draining operation, the pump 200 may be operated to discharge the garbage which remains at the sump 100 with the washing water outside the body 10.

In the drying operation, a heater (not shown) mounted in the washing tub 30 may be operated to dry dishes.

Figure 4:
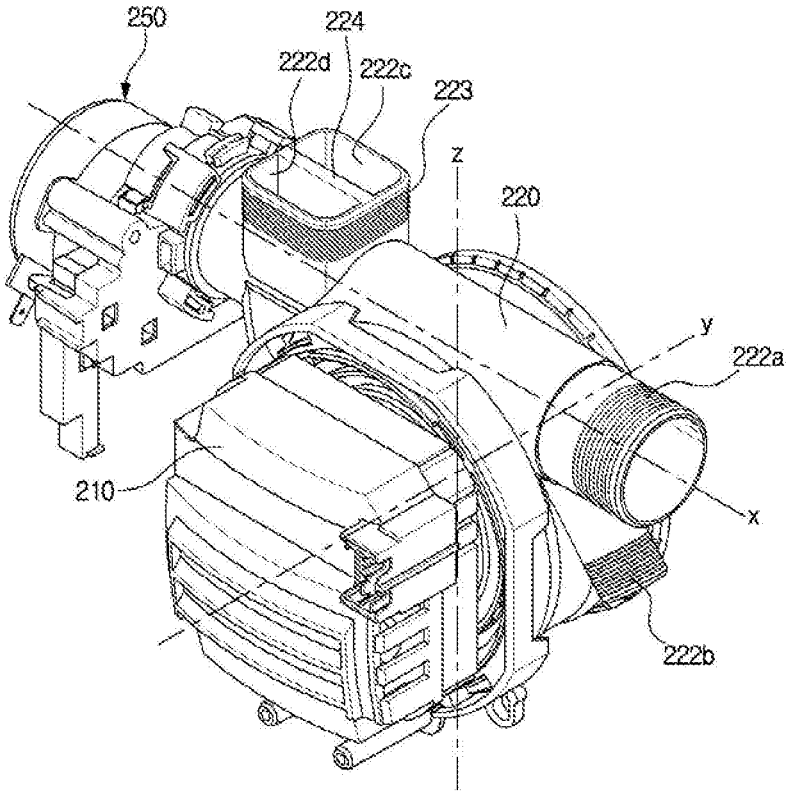
FIG. 4 is a perspective view of the pump 200.
Figure 5:
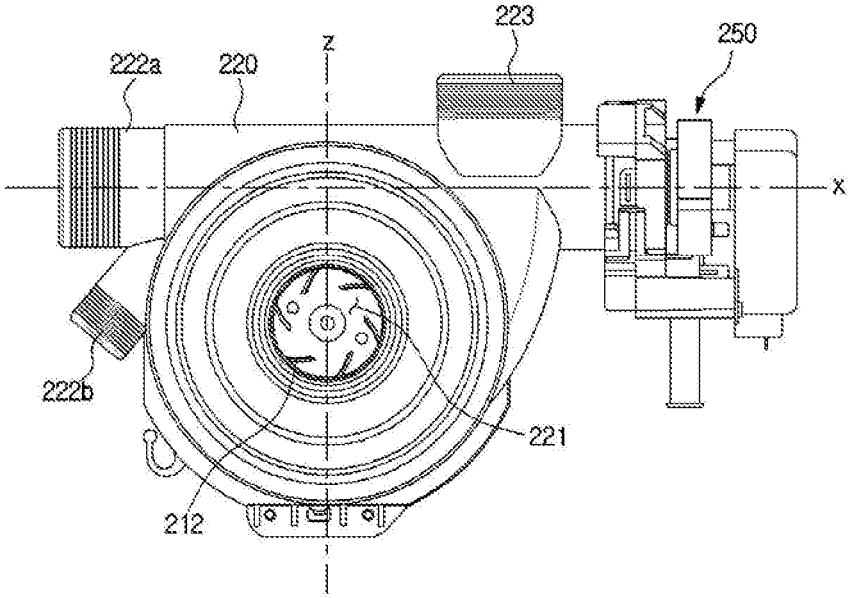
FIG. 5 is a rear view of the pump 200.
Figure 6:
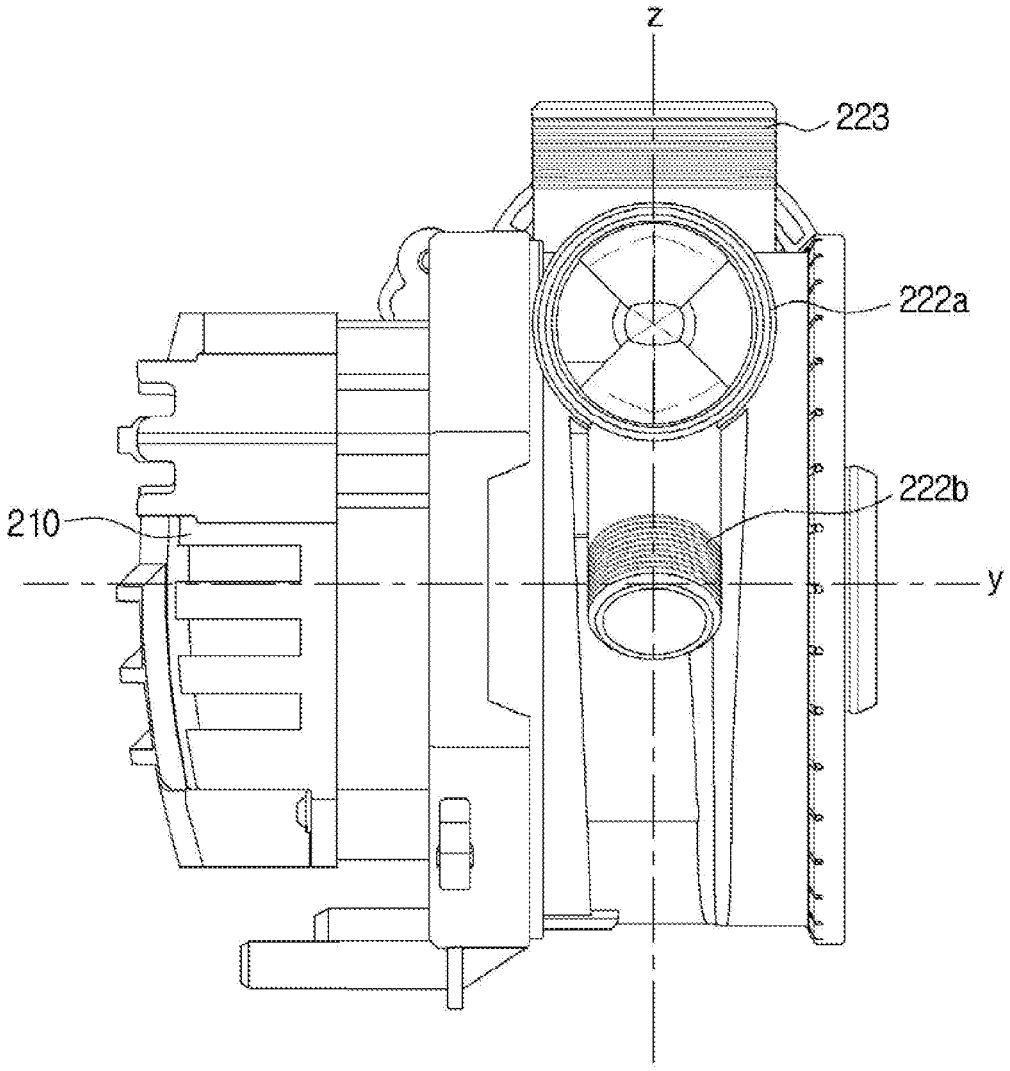
FIG. 6 is a right side view of the pump 200.

FIGS. 4 to 6 are views illustrating the pump 200 of the dish washing machine 1 according to one embodiment of the disclosure.

FIG. 4 is a perspective view of the pump 200, FIG. 5 is a rear view of the pump 200, and FIG. 6 is a right side view of the pump 200.

Referring to FIGS. 4 to 6, the pump 200 may include a pumping motor 210 which generates torque to pump washing water stored in the sump 100, a motor shaft 211 for transferring the torque generated by the pumping motor 210, an impeller 212 which rotates to move washing water by being coupled with the motor shaft 211, and a housing 220 including a plurality of outlets 222*a*, 222*b*, 222*c*, and 222*d* which discharge the pumped washing water to jet nozzles.

In FIGS. 4 to 6, a longitudinal direction of the housing 220 of the pump 200 is defined as an x-axis direction x, and a lateral direction of the pump 200 is defined as a y-axis direction y. Also, a direction which perpendicularly intersects with both the x-axis direction x and the y-axis direction y is defined as a z-axis direction z. Also, throughout the specification, a vertical direction of the housing 220 will be based on FIGS. 5 and 6.

The housing 220 may include an inlet 221 through which washing water flows into the housing 220. The inlet 221 may be formed to open in the y-axis direction y which is a width direction.

The pumping motor 210 may convert electrical force into mechanical torque. The pumping motor 210 may include a stator and a rotor which electromagnetically interworks with the stator to rotate. The impeller 212 may move the washing water to flow into the housing 220 through the inlet 221 and move the washing water which flows in to be discharged outside the housing 220 through the outlets 222*a*, 222*b*, 222*c*, and 222*d*. The impeller 212 may be configured to allow washing water to flow in an axial direction and be discharged in a radial direction.

The plurality of outlets 222*a*, 222*b*, 222*c*, and 222*d* may include a first outlet 222*a* open in the x-axis direction x which is the longitudinal direction of the housing 220, a second outlet 222*b* open downward from the x-axis direction by a certain angle from 40 degrees to 50 degrees, and a third outlet 222*c* and a fourth outlet 222*d* open in the z-axis direction z which is an upper direction of the housing 220.

As an example, the third outlet 222*c* and the fourth outlet 222*d* may be connected by a socket 223. The socket 223 may be formed along outer circumferential surfaces of the third outlet 222*c* and the fourth outlet 222*d*.

The third outlet 222*c* and the fourth outlet 222*d* may be divided by an intermediate wall 224. The third outlet 222*c* and the fourth outlet 222*d* may be arranged along the y-axis direction y which is the width direction.

The plurality of outlets 222*a*, 222*b*, 222*c*, 222*d* may be connected to a plurality of such hoses 271*a*, 271*b*, 271*c*, and 271*d*, respectively. Accordingly, the washing water pumped by an operation of the pumping motor 210 may be supplied to each of the plurality of jet nozzles 311, 313, 330, and 340 through the plurality of outlets 222*a*, 222*b*, 222*c*, and 222*d*, and the plurality of hoses 271*a*, 271*b*, 271*c*, and 271*d*.

FIGS. 7 to 10 are cross-sectional views illustrating the pump 200 of the dish washing machine 1 according to one embodiment of the disclosure.

Figure 7:
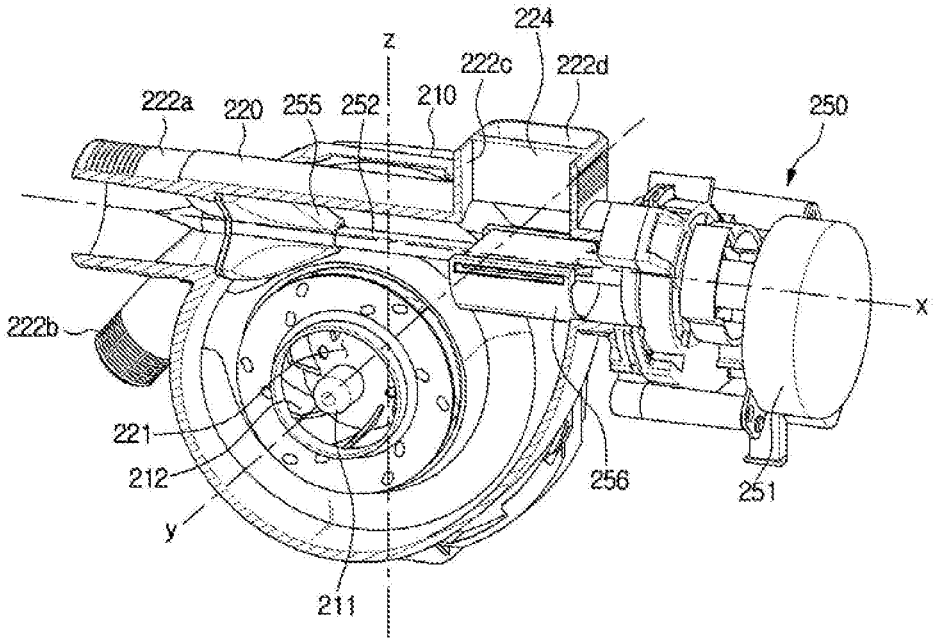
FIG. 7 is a perspective cross-sectional view of the pump 200, longitudinally taken along the x-axis direction x.
Figure 8:
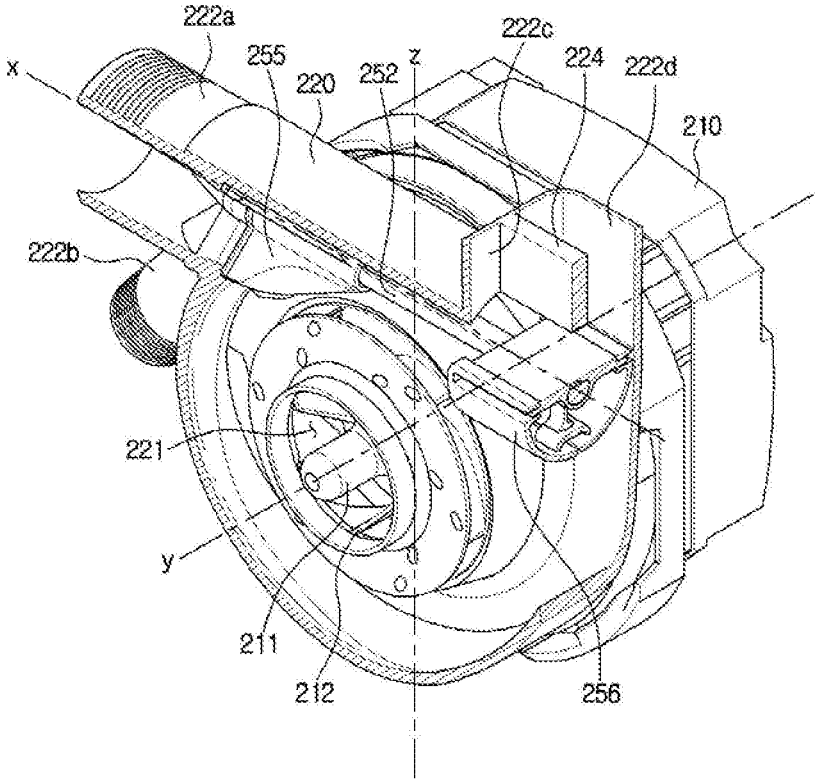
FIG. 8 is a perspective cross-sectional view of the pump 200, longitudinally taken along the x-axis direction x, viewed from another angle.

FIG. 7 is a perspective cross-sectional view of the pump 200, longitudinally taken along the x-axis direction x. FIG. 8 is a perspective cross-sectional view of the pump 200, longitudinally taken along the x-axis direction x, viewed from another angle.

Figure 9:
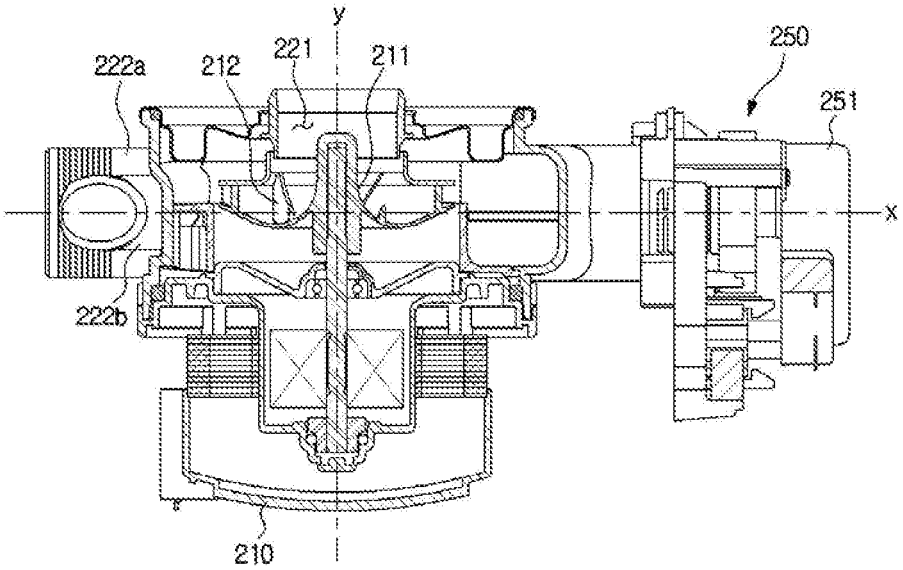
FIG. 9 is a cross-sectional view of the pump 200, laterally taken along the x-axis direction x.
Figure 10:
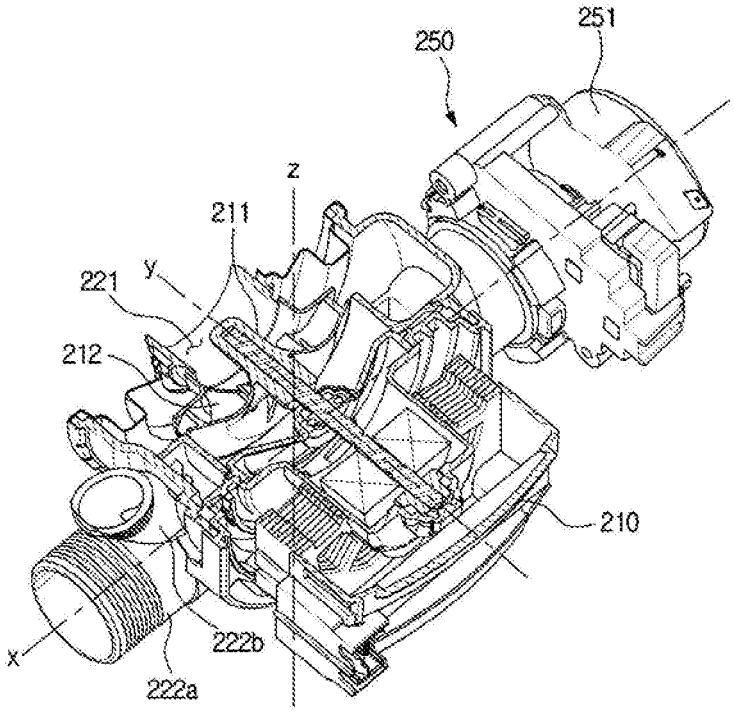
FIG. 10 is a perspective cross-sectional view of the pump 200, laterally taken along the x-axis direction x.

FIG. 9 is a cross-sectional view of the pump 200, laterally taken along the x-axis direction x. FIG. 10 is a perspective cross-sectional view of the pump 200, laterally taken along the x-axis direction x.

In FIGS. 7 to 10, the distributor 250 may be detachably coupled in the housing 220 with respect to the x-axis direction of the housing 220 of the pump 200. The distributor 250 may be positioned above the housing 220 of the pump 200.

The distributor 250 may include opening and closing members 255 and 256, a distributor motor 251 which generates torque to rotate the opening and closing members 255 and 256, and a motor shaft 252 which transfers the torque generated by the distributor motor 251 to the opening and closing members 255 and 256.

The motor shaft 252 may face a direction different from a y direction faced by the motor shaft 211 of the pumping motor 210. That is, the motor shaft 252 of the distributor 250 and the motor shaft 211 of the pumping motor 210 may not be parallel to each other.

As an example, the direction which the motor shaft 252 may be perpendicular or approximately perpendicular to a direction which the motor shaft 211 of the pumping motor 210 faces. The approximately perpendicular direction may be, for example, one within a range from 60 degrees to 120 degrees.

As an example, the direction which the motor shaft 252 faces may be identical to the longitudinal direction x of the housing 220 of the pump 200. That is, the direction which the motor shaft 252 faces may be an x direction x.

The opening and closing members 255 and 256 may be positioned in the housing 220 of the pump 200. The opening and closing members 255 and 256 may be coupled with the motor shaft 252 to rotate with rotation of the motor shaft 252 in the housing 220. In this case, the opening and closing members 255 and 256 may be detachably coupled with the motor shaft 252.

According to the rotation of the motor shaft 252 of the distributor motor 251, the opening and closing members 255 and 256 may selectively open and close the plurality of outlets 222*a*, 222*b*, 222*c*, and 222*d*.

Accordingly, the distributor 250 may distribute washing water pumped by the pumping motor 210 to the plurality of jet nozzles 311, 313, 330, and 340 for discharging.

According to an embodiment, as the diameter of the motor shaft 252 decreases, the plurality of outlets 222*a*, 222*b*, 222*c*, and 222*d* may be configured to become closer to the center of the pumping motor 210. Accordingly, water pressure of washing water which flows into the pump 200 may be maximally maintained and discharged through the outlets 222*a*, 222*b*, 222*c*, and 222*d*, thereby increasing efficiency of the pump 200. On the contrary, as diameter of the motor shaft 252 increases, the plurality of outlets 222*a*, 222*b*, 222*c*, and 222*d* may be configured to become farther from the center of the pumping motor 210. In this case, the efficiency of the pump 200 may be reduced.

Figure 11:
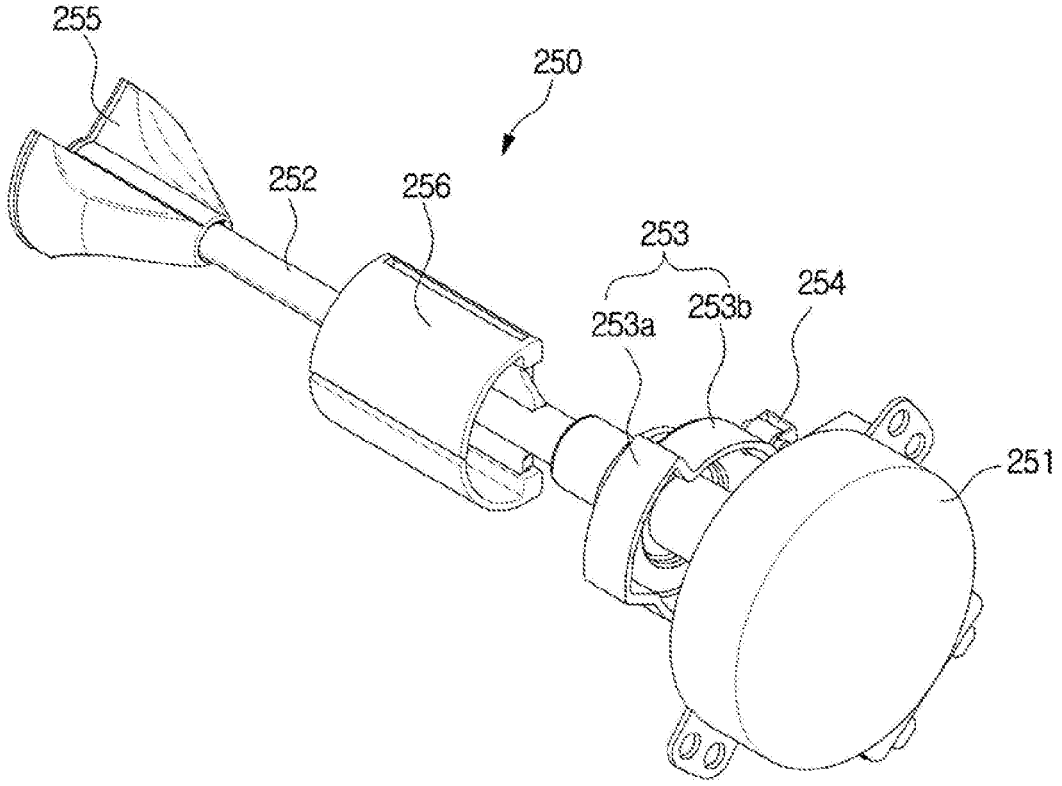
FIG. 11 is a perspective view of the distributor 250 of the dish washing machine 1 according to an embodiment of the disclosure.

FIG. 11 is a perspective view of the distributor 250 of the dish washing machine 1 according to an embodiment of the disclosure.

In FIG. 11, the distributor 250 may include the opening and closing members 255 and 256, the distributor motor 251 which generates torque to rotate the opening and closing members 255 and 256, and the motor shaft 252 which transfers the torque generated by the distributor motor 251 to a plurality of such opening and closing members 255 and 256. In this case, the plurality of opening and closing members 255 and 256 may be coupled with the motor shaft 252 and may rotate according to the rotation of the motor shaft 252.

A first opening and closing member 255 of the plurality of opening and closing members 255 and 256 may be provided at one end of the motor shaft 252, and a second opening and closing member 256 may be provided at one surface of the motor shaft 252. That is, the second opening and closing member 256 may be provided between both ends of the motor shaft 252. The second opening and closing member 256 may be provided to protrude outward in a radial direction from an outside circumferential surface of the motor shaft 252.

The distributor 250 may include a cam member 253 coupled with the motor shaft 252 and a micro switch 254 in contact with the cam member 253 to sense a rotation position of the opening and closing member. The cam member 253 may be configured to be in contact with a contact terminal of the micro switch 254. The cam member 253 may include at least one convex portion 253*a* which protrudes in a radial direction and at least one concave portion 253*b* which is depressed in the radial direction to turn on and off the micro switch 254.

It may be assumed that the micro switch 254 is configured to be turned on when the contact terminal of the micro switch 254 is in contact with the convex portion 253*a* of the cam member 253 and turned off when in contact with the concave portion 253*b* of the cam member 253. In this case, when the distributor motor 251 operates, the micro switch 254 may be alternatingly turned on and off.

Meanwhile, the distributor 250 may include a control portion which designates rotation positions of the plurality of opening and closing members 255 and 256 according to time of turning on or off of the micro switch 254 and rotates or stops a motor 230 to rotate the plurality of opening and closing members 255 and 256 to particular rotation positions, which are necessary, among the designated rotation positions. The control portion may be configured as an electronic circuit.

Figure 12:
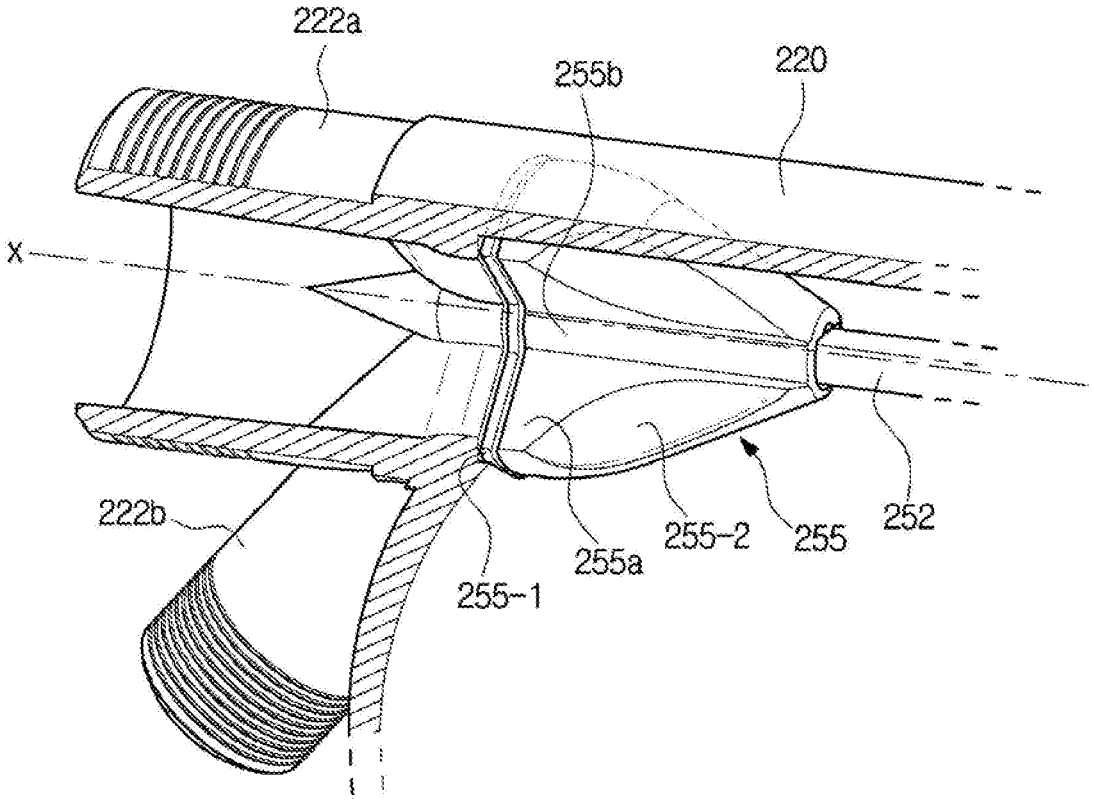
FIG. 12 is a perspective view of the first opening and closing member 255 of the dish washing machine 1 according to an embodiment of the disclosure.

FIG. 12 is a perspective view of the first opening and closing member 255 of the dish washing machine 1 according to an embodiment of the disclosure.

In FIG. 12, the first opening and closing member 255 may include at least one ridge 255*a* and at least one valley 255*b*. The at least one ridge 255*a* and the at least one valley 255*b* may be alternately formed along a circumferential direction of the motor shaft 252.

According to the rotation of the motor shaft 252, the first opening and closing member 255 may selectively open and close the plurality of outlets 222*a* and 222*b*.

For example, when the motor shaft 252 rotates by a first angle based on the x-axis direction x, the first outlet 222*a* may be closed by the at least one ridge 255*a* of the first opening and closing member 255 and the second outlet 222*b* may be opened by the at least one valley 255*b* of the first opening and closing member 255.

Otherwise, when the motor shaft 252 rotates by a second angle based on the x-axis direction x, the first outlet 222*a* may be opened by the at least one valley 255*b* of the first opening and closing member 255, and the second outlet 222*b* may be closed by the at least one ridge 255*a* of the first opening and closing member 255.

The first opening and closing member 255 may include a cap 255-1 formed along cross sections of a plurality of such ridges 255*a* at a front. The cap 255-1 positioned at the front may come into close contact with the first outlet 222*a* and may cut off leakage of washing water when the first opening and closing member 255 closes the first outlet 222*a*.

As an example, the ridge 255*a* of the first opening and closing member 255 may include a guide surface 255-2. For example, the first opening and closing member 255 may include the guide surface 255-2 formed by depressing a side of the ridge 255*a*. The guide surface 255-2 may improve flow of washing water in the pump 200 by guiding the washing water to the outlet 222*a*.

Figure 13:
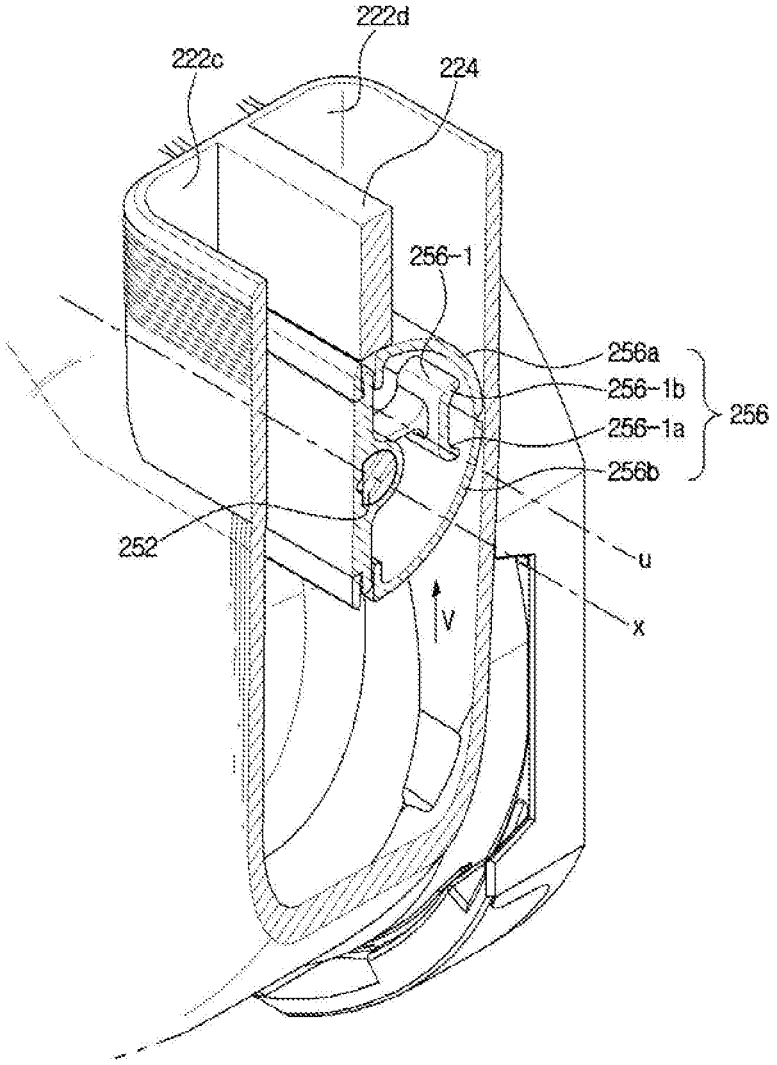
FIGS. 13 and 14 are views of the second opening and closing member 256 according to an embodiment of the disclosure.
Figure 14:
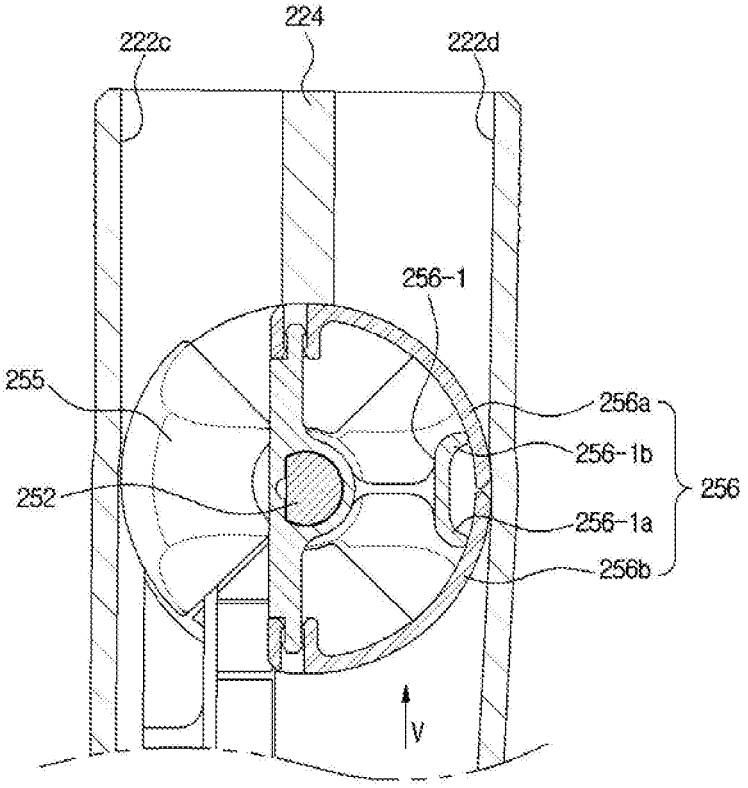

FIGS. 13 and 14 are views of the second opening and closing member 256 according to an embodiment of the disclosure.

FIG. 13 is a perspective view of the opening and closing member 256, and FIG. 14 is a cross-sectional view of the opening and closing member 256.

Referring to FIGS. 13 and 14, the second opening and closing member 256 may include a first blade 256*a* which forms a curved surface and a second blade 256*b* which forms a curved surface.

According to the rotation of the motor shaft 252, the second opening and closing member 256 may open and close at least one of the plurality of outlets 222*c* and 222*d*.

For example, when the motor shaft 252 rotates by the first angle based on the x-axis direction x, the third outlet 222*c* may be closed and a hole of the fourth outlet 222*d* may be opened by the first blade 256*a* of the second opening and closing member 256.

Otherwise, when the motor shaft 252 rotates by the second angle based on the x-axis direction x, the hole of the fourth outlet 222*d* may be closed and the third outlet 222*c* may be opened by the second blade 256*b* of the second opening and closing member 256.

Otherwise, when the motor shaft 252 rotates by a third angle based on the x-axis direction x, the third outlet 222*c* may be closed by the first blade 256*a* of the second opening and closing member 256 and the hole of the fourth outlet 222*d* may be closed by the second blade 256*b*.

A lever 256-1 may be positioned between the first blade 256*a* and the second blade 256*b* of the second opening and closing member 256. The lever 256-1 may support the first blade 256*a* or the second blade 256*b* to come into in close contact with a hole of the third outlet 222*c* or the hole of the fourth outlet 222*d*.

Also, the lever 256-1 may flexibly move upward and downward based on a u-axis direction u. For example, when the third outlet 222*c* is opened and the fourth outlet 222*d* is closed by the second opening and closing member 256, washing water flows in a direction v in which the closed fourth outlet 222*d* is positioned to apply water pressure to the curved surface of the second blade 256*b* of the second opening and closing member 256. In this case, as the second blade 256*a* is bent inward, pressure may be applied to one end 256-1*a* of the lever 256-1, and then the one end 256-1*a* of the lever 256-1 and another end 256-1*b* of the lever 256-1 may be bent clockwise with respect to the u-axis u. The other end 256-1*b* of the lever 256-1 which rotates clockwise may apply pressure to allow the first blade 256*a* of the second opening and closing member 256 to be bent outward. Accordingly, the first blade 256*a* may be in close contact with the hole of the fourth outlet 222*d* to completely close the fourth outlet 222*d*.

Figure 15:
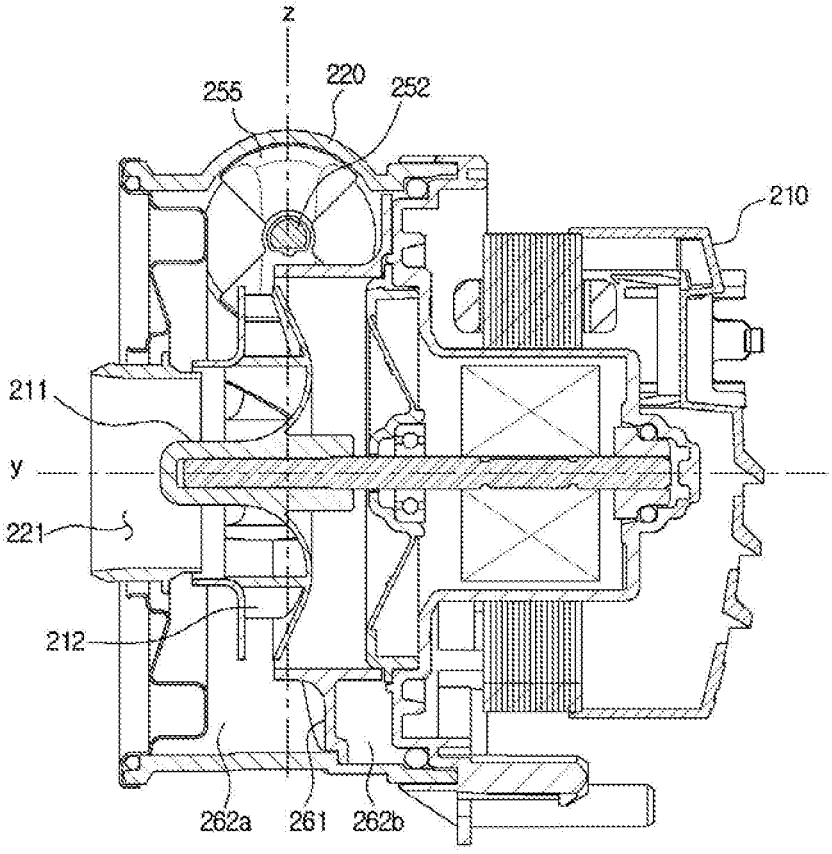
FIG. 15 is a cross-sectional view of the pump 200 longitudinally taken along the y-axis direction y.
Figure 16:
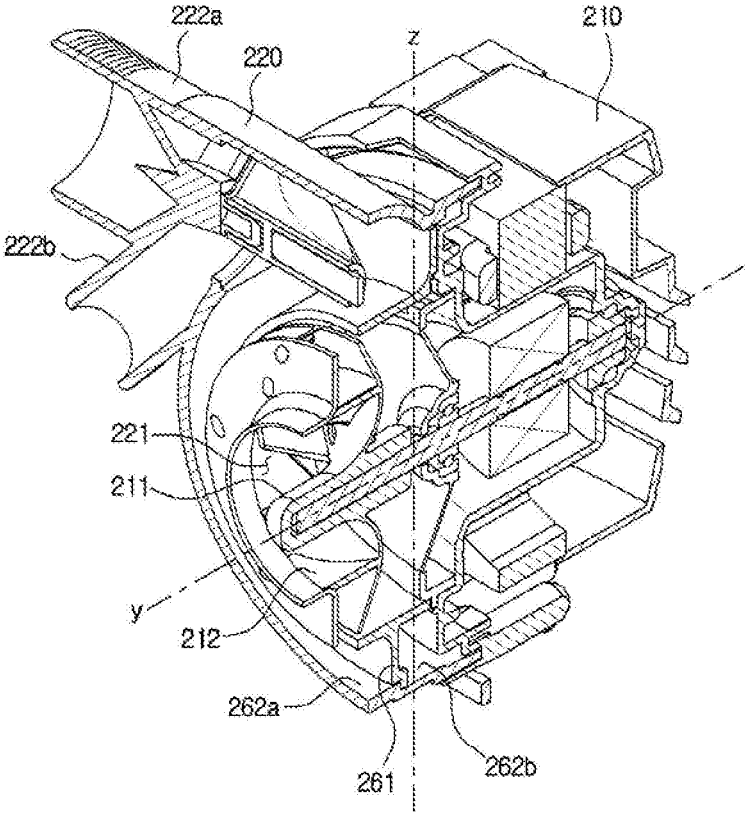
FIG. 16 is a perspective cross-sectional view of the pump 200 longitudinally taken along the y-axis direction y.

FIGS. 15 to 16 are cross-sectional views of the pump 200 of the dish washing machine 1 according to an embodiment of the disclosure.

FIG. 15 is a cross-sectional view of the pump 200 longitudinally taken along the y-axis direction y. FIG. 16 is a perspective cross-sectional view of the pump 200 longitudinally taken along the y-axis direction y.

Referring to FIGS. 15 and 16, the housing 220 of the pump 200 may include a spiral partition wall 261 formed along an inner circumferential surface. A spiral or radial flow channel 262*a* through which washing water flows may be generated on the inner circumferential surface of the housing along the spiral partition wall 261. Also, as the pumping motor 210 is coupled with the housing 220, a flow channel 262*b* through which washing water may flow may be generated on an inner circumferential surface of the between the pumping motor 210 and the housing 220.

As an example, the spiral partition wall 261 may be embodied to be detachable from the housing 220 of the pump 200. Otherwise, the spiral partition wall 261 may be embodied to be a part of the housing 220.

Washing water may be accelerated along at least one of the flow channels 262*a* and 262*b* and may be discharged to nozzles though the plurality of outlets 222*a*, 222*b*, 222*c*, and 222*d*.

The distributor 250 may be configured to have three distribution modes as described above.

Figure 17:
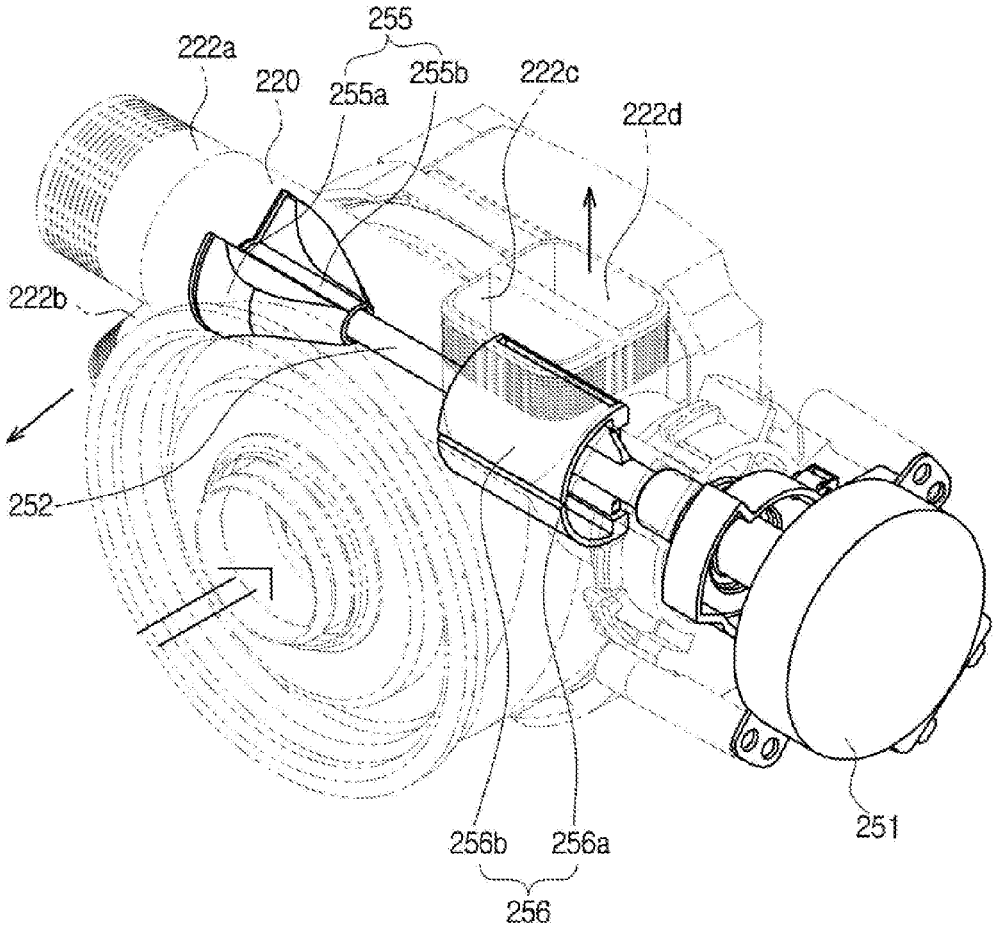
FIGS. 17 to 19 are views illustrating states of the opening and closing members 255 and 256 according to each of the three distribution modes of the distributor 250.
Figure 18:
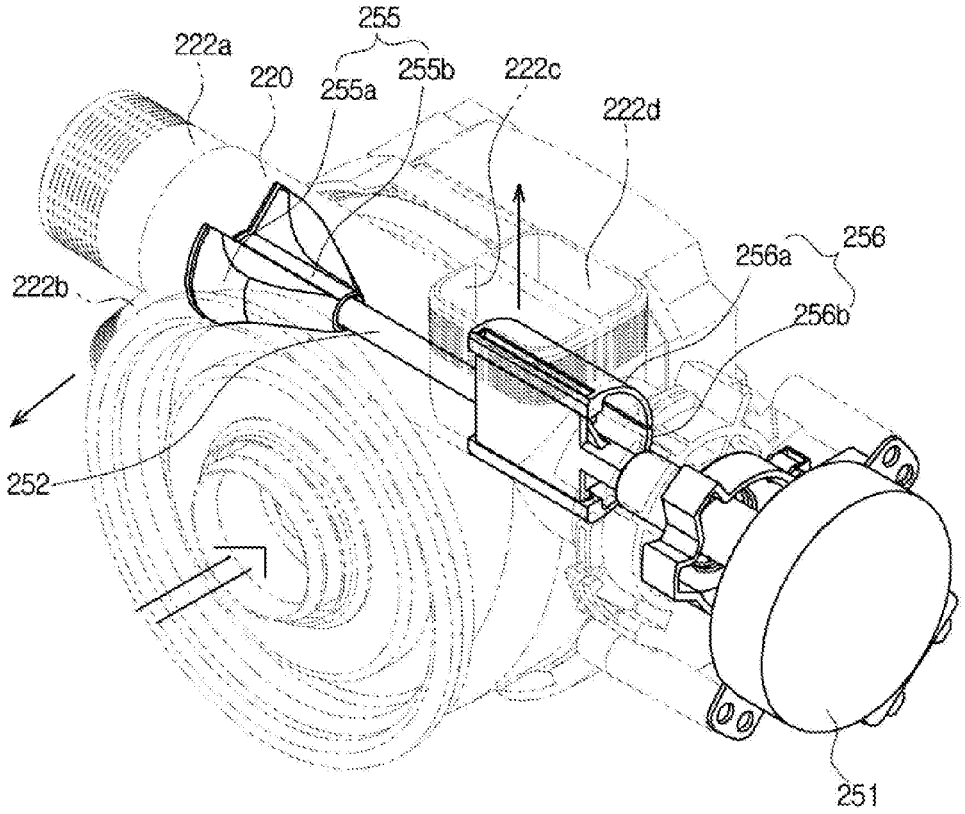
Figure 19:
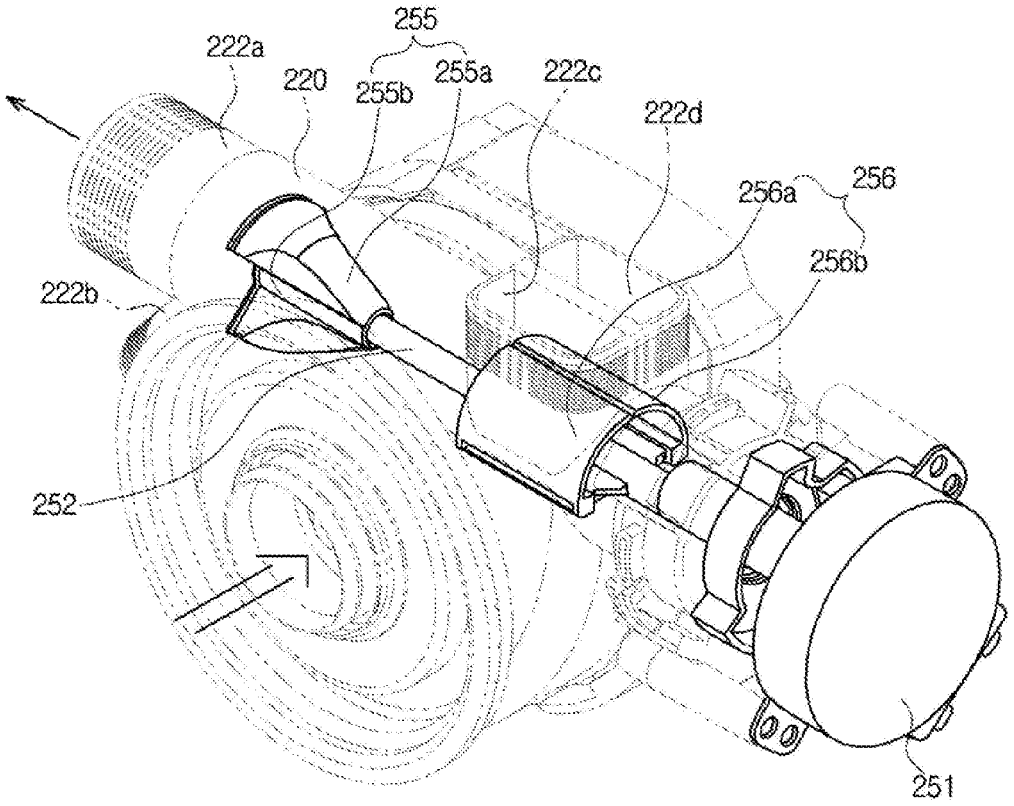

FIGS. 17 to 19 are views illustrating states of the opening and closing members 255 and 256 according to each of the three distribution modes of the distributor 250.

FIG. 17 illustrates a state in which the distributor 250 is in a first mode.

In the first mode, according to the rotation of the motor shaft 252, the ridge 255*a* of the first opening and closing member 255 may close the first outlet 222*a* and the second blade 256*b* of the second opening, and closing member 256 may close the third outlet 222*c*. Accordingly, the pump 200 may supply washing water only to the intermediate rotating nozzle 313 and the right fixed nozzle 340 through the second hose 271*b* connected to the second outlet 222*b* and the fourth hose 271*d* connected to the fourth outlet 222*d*.

FIG. 18 illustrates a state in which the distributor 250 is in a second mode.

In the second mode, according to the rotation of the motor shaft 252, the ridge 255*a* of the first opening and closing member 255 may close the first outlet 222*a*, and the first blade 256*a* of the second opening and closing member 256 may close the fourth outlet 222*d*. Accordingly, the pump 200 may supply washing water only to the intermediate rotating nozzle 313 and the left fixed nozzle 330 through the second hose 271*b* connected to the second outlet 222*b* and the third hose 271*c* connected to the third outlet 222*c*.

FIG. 19 illustrates a state in which the distributor 250 is in a third mode.

In the third mode, according to the rotation of the motor shaft 252, the ridge 255*a* of the first opening and closing member 255 may close the second outlet 222*b*, the first blade 256*a* of the second opening and closing member 256 may close the third outlet 222*c*, and the second blade 256*b* of the second opening and closing member 256 may close the fourth outlet 222*d*. Accordingly, the pump 200 may supply washing water only to the upper rotating nozzle 311 through the first hose 271*a* connected to the first outlet 222*a*.

As is apparent from the above description, according to one or more embodiments of the disclosure, an opening and closing member for opening or closing a plurality of outlets is provided in a housing of a pump, thereby increasing efficiency of the pump.

Also, as the plurality of outlets and the opening and closing member are positioned at a top end of the housing of the pump, an overall external shape of the housing of the pump may be embodied in a spiral shape. Accordingly, compared with an existing cylindrical pump housing, the efficiency of the pump may be increased.

Also, as the plurality of outlets and the opening and closing member are positioned at the top end of the housing of the pump, air is well discharged from the pump, thereby reducing an air track of the pump.

Also, according to mechanical features of the opening and closing member, the opening and closing member may be used not only to open or close the outlets but also to guide flow of washing water.

Also, since a diameter of a distributor is embodied to be small and positioned in the housing of the pump, torque for rotating the opening and closing member may be reduced, and energy efficiency may be increased.

Also, the distributor and components thereof may be easily replaceable. Particularly, the distributor may be easily separated from the housing of the pump based on a shaft of the distributor.

As described above, as the efficiency of the pump is increased, dishes disposed in a dish washing machine may be wiped cleaner and energy efficiency for operating the dish washing machine may be increased.

The scope of the disclosure is not limited to the particular embodiments described above. It should be appreciated that various other embodiments modifiable or changeable by one of ordinary skill in the art within a range without departing from the essence as the technical concept of the disclosure defined by the claims are also included in the scope of the disclosure.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A dish washing machine, comprising:

a body;

a plurality of jet nozzles configured to jet washing water;

a sump configured to store the washing water;

a pump including a pumping motor configured to pump the washing water stored in the sump, a pumping motor shaft, and a housing including a plurality of outlets; and a distributor configured to distribute the washing water pumped by the pump to at least one of the plurality of jet nozzles through at least one of the plurality of outlets, the distributor including:

a distributor motor shaft having an axial direction different from an axial direction of the pumping motor shaft, at least one opening and closing member configured to be rotatable in the housing of the pump to selectively open and close at least one of the plurality of outlets, and a distributor motor configured to rotate the at least one opening and closing member about the distributor motor shaft, wherein the at least one opening and closing member includes a first opening and closing member and a second opening and closing member disposed along the axial direction of the distributor motor shaft.

2. The dish washing machine of claim 1, wherein at least one of the plurality of outlets has an opening in a longitudinal direction of the housing.

3. The dish washing machine of claim 1, wherein at least one of the plurality of outlets has an opening in an upward direction of the housing.

4. The dish washing machine of claim 1, wherein at least one of the plurality of outlets has an opening in a downward direction at an angle from 40 degrees to 50 degrees with respect to a longitudinal direction of the housing.

5. The dish washing machine of claim 1, wherein the axial direction of the distributor motor shaft faces is in a same direction as a longitudinal direction of the housing of the pump.

6. The dish washing machine of claim 1, wherein the axial direction the distributor motor shaft is perpendicular or approximately perpendicular to the axial direction of the pumping motor shaft.

7. The dish washing machine of claim 1, wherein the distributor is detachably coupled with one longitudinal end portion of the housing.

8. The dish washing machine of claim 1, wherein the first opening and closing member is disposed at one end of the distributor motor shaft, and the second opening and closing member is disposed between the one end of the distributor motor shaft and another end of the distributor motor shaft.

9. The dish washing machine of claim 1, wherein the at least one opening and closing member includes at least one ridge and at least one valley, and according to rotation of the distributor motor shaft, one of the plurality of outlets is closed by the at least one ridge and another one of the plurality of outlets is opened by the at least one valley.

10. The dish washing machine of claim 1, wherein the at least one opening and closing member includes a cap which comes into close contact with a hole of one of the at least one of the plurality of outlets and cuts off leakage of the washing water when the one of the at least one of the plurality of outlets is closed by the at least one opening and closing member.

11. The dish washing machine of claim 1, wherein the at least one opening and closing member includes at least one ridge and at least one valley, and the at least one ridge includes a guide surface configured to guide the washing water.

12. The dish washing machine of claim 1, wherein the at least one opening and closing member includes a first blade and a second blade and closes at least one of the plurality of outlets using at least one of the first blade and the second blade.

13. The dish washing machine of claim 12, wherein the at least one opening and closing member further includes a lever positioned between the first blade and the second blade, and the lever is configured to support at least one of the first blade and the second blade to come into close contact with at least one hole of the at least one of the plurality of outlets when the at least one of the plurality of outlets is closed by the at least one opening and closing member.

14. The dish washing machine of claim 1, wherein the housing includes a spiral partition wall disposed along an inner circumferential surface of the housing to provide a flow channel of the washing water.

15. The dish washing machine of claim 1, wherein the distributor further includes:

a cam member coupled with the distributor motor shaft to rotate with the at least one opening and closing member, and a micro switch in contact with the cam member to sense a rotation position of the at least one opening and closing member.

16. The dish washing machine of claim 15, wherein the cam member includes a convex portion and a concave portion alternately disposed along a circumferential direction to turn on and off the micro switch according to rotation of the cam member.

17. The dish washing machine of claim 15, wherein the distributor further includes a control portion which designates rotation positions of the at least one opening and closing member according to a time of turning on and off of the micro switch and rotates or stops the distributor motor to rotate the at least one opening and closing member.

18. The dish washing machine of claim 1, wherein the plurality of outlets include a first outlet and a second outlet, the first outlet has an opening in a longitudinal direction of the housing, the second outlet has an opening in a downward direction at an angle from 40 degrees to 50 degrees with respect to the longitudinal direction of the housing, and the first outlet and second outlet are selectively opened and closed according to rotation of the distributor motor shaft.

19. The dish washing machine of claim 1, wherein at least one of a first outlet and a second outlet, among the plurality of outlets, has an opening in an upward direction of the housing that is selectively opened and closed according to rotation of the at least one opening and closing member.

20. A dish washing machine, comprising:

a pump including a pumping motor configured to pump washing water, a pumping motor shaft, and a housing including a plurality of outlets; and a distributor configured to distribute the washing water pumped by the pumping motor to at least one of a plurality of jet nozzles through at least one of the plurality of outlets, the distributor including:

a distributor motor shaft having an axial direction different from an axial direction of the pumping motor shaft;

at least one opening and closing member configured to be rotatable in the housing of the pump to selectively open and close at least one of the plurality of outlets; and a distributor motor which rotates the at least one opening and closing member about the distributor motor shaft, wherein the at least one opening and closing member includes a first opening and closing member and a second opening and closing member disposed along the axial direction of the distributor motor shaft.

* * * * *